US005463929A

United States Patent [19]

Mejia

[11] Patent Number: 5,463,929

[45] Date of Patent: Nov. 7, 1995

[54] ARMORING MATERIAL MOUNTING ASSEMBLY

[76] Inventor: Santiago Mejia, P.O. Box 27657, Bogota, Colombia

[21] Appl. No.: 277,621

[22] Filed: Jul. 20, 1994

[51] Int. Cl.[6] ..... F41H 5/013

[52] U.S. Cl. ..... 89/36.02; 109/49.5; 109/82

[58] Field of Search ..... 89/36.01, 36.02; 109/49.5, 79, 80, 82, 83, 84; 428/911

[56] References Cited

U.S. PATENT DOCUMENTS

| | | | |
|---|---|---|---|
| 530,410 | 12/1894 | Giessler | 109/84 |
| 1,250,197 | 12/1917 | Louppe | 109/49.5 |
| 1,270,343 | 6/1918 | Szmyt | 89/36.02 |
| 2,640,987 | 6/1953 | Ehlers | 89/36.02 |
| 2,733,177 | 1/1956 | Myers | 89/36.02 |
| 3,491,847 | 1/1970 | Abbott | 109/49.5 |
| 3,683,828 | 8/1972 | Alliegro et al. | 109/83 |
| 3,859,892 | 1/1975 | Coes | 109/80 |
| 4,321,777 | 3/1982 | Sauret et al. | 52/308 |
| 4,674,394 | 6/1987 | Martino | 89/36.05 |
| 4,780,351 | 10/1988 | Czempoyesh | 428/122 |
| 4,822,657 | 4/1989 | Simpson | 89/36.02 |
| 4,824,624 | 4/1989 | Palicka | 109/49.5 |
| 5,200,256 | 4/1993 | Dunbar | 89/36.01 |

FOREIGN PATENT DOCUMENTS

| | | | |
|---|---|---|---|
| 866239 | 7/1941 | France | 89/36.02 |
| 4203936 | 8/1993 | Germany | 89/36.02 |

*Primary Examiner*—Stephen M. Johnson
*Attorney, Agent, or Firm*—Shlesinger, Arkwright & Garvey

[57] ABSTRACT

An armoring material single or multilayered is provided with reinforced edge fastening to absorb impact of ballistic projectiles and to prevent delamination of the armoring material from the protected surface when a ballistic projectile strikes it.

18 Claims, 11 Drawing Sheets

ARMORING MATERIAL MOUNTING ASSEMBLY

FIELD OF THE INVENTION

This invention relates to an armoring material mounting assembly which is resistant to failure caused by ballistic projectile impact.

BACKGROUND OF THE INVENTION

Within the last ten to twenty years a new type of armoring material has been introduced to further increase the effectiveness of armoring surfaces to preclude their being pierced by bullets or other ballistic projectiles. These materials are applied to the surface of the vehicle or structure to be protected in the form of individual pieces which form overall composite structure surface resistant to bullets or other types of projectiles.

This type of armoring material has universal application, and can be applied to the surfaces of automobiles, helicopters, airplanes, or buildings, wherever there is a need to make a surface impenetrable to bullets and other projectiles that could be injurious to people or installations.

This material can either be a woven fiber or non-woven overlaid fiber formed of multiple layers of fabric which are united by any typical technique, such as sewing, fastening with staples for example, and adhesion bonding including hot pressing. Ordinarily, these armoring materials such as aramids, woven nylon and polyethylene ultra high molecular weight (UHMW), are more resistant to penetration and puncture by bullets or projectiles, themselves, but due to the weaknesses at the periphery of these individual armoring pieces forming the composite, are less effective than a single uniform piece of material. However, due to the differences in shape as well as limitations as to size of the pieces, it is impractical to provide one large unitary sheet of armoring material to protect a given surface.

When a projectile or bullet strikes the armoring material adjacent its edge there is a tendency for it to separate the armoring material from the surface to which it is adhered, breaking the bond between adjacent pieces which may be either sewed, fastened or glued together, or torn from the actual surface on which it is mounted. Consequently, the tendency of the armoring surface to sustain damage in this manner substantially decreases its effectiveness as an armoring surface. A more effective manner of joining composite pieces to the surface to be protected, and to adjacent pieces of the composite surface is therefore necessary if the full potential of the armoring fabric to protect a given surface is to be realized.

SUMMARY OF THE INVENTION

This invention is directed to a particular manner of more effectively mounting individual pieces of a composite surface of armoring material sections, in order to provide a more effective impenetrable ballistic projectile surface than heretofore possible.

The invention provides a for a specific mounting arrangement for armoring material which reinforces the edges of such material to prevent failure due to delamination of the armoring material under impact.

This invention also provides for a readily useable type of frame for engaging the edge periphery of armoring material and which will enable the assembly to withstand impact of a ballistic projectile along the edges of a given piece or section of armoring material.

This invention also provides a framing system which grips the armoring material along the edges in such a way as to preclude tearing and failure when either at that point or where the central part of the panel itself is impacted by a ballistic projectile.

DESCRIPTION OF THE INVENTION

Figure 1:
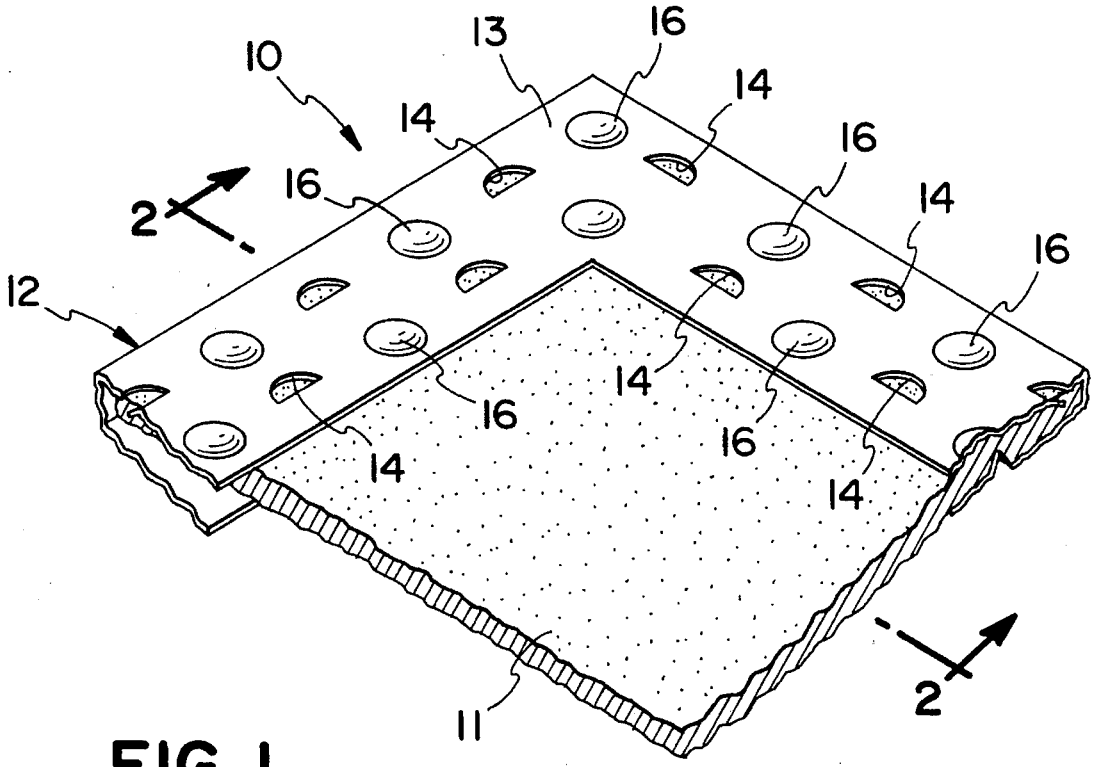
FIG. 1 is a partial perspective view of a frame and section of armoring material.
Figure 2:
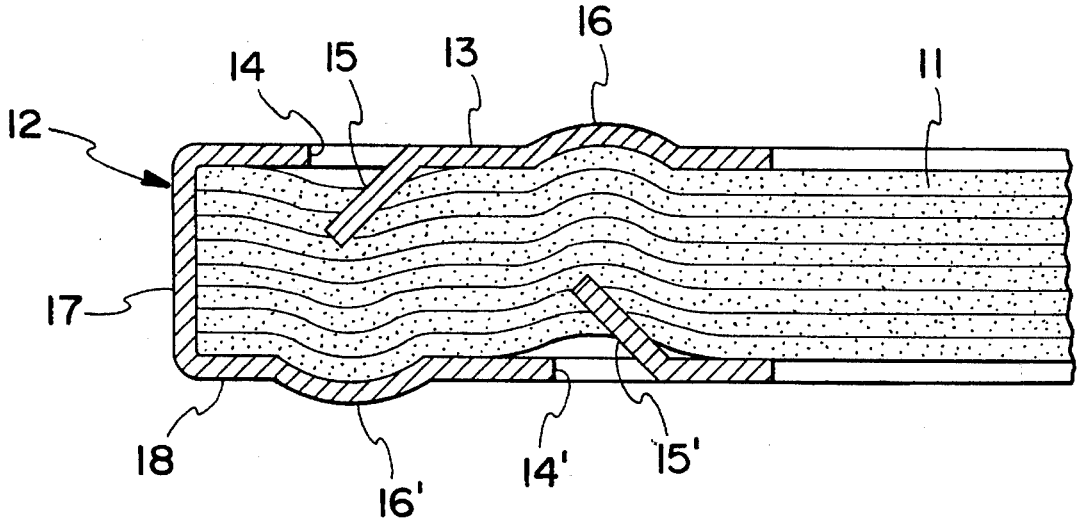
FIG. 2 is a cross-sectional view of FIG. 1.

FIGS. 1 and 2 show an edge frame construction for an armoring material which due to edge reinforcement will enhance resistance to failure when the edge portion or a section close thereto is struck by a ballistic projectile. Any reassembly generally indicated at 10 has an edge and corner protecting section illustrated in FIGS. 1 and 2 made of impact resistant metal having an upper surface 13 containing a series of relatively closely spaced punched out sections 14 disposed in a line. The punched out section 15 is pressed into the armoring material 11 to hold it in position.

Armoring materials as used in this description refers to particular projectile resistant fabrics which consist of multiple layers of fabrics such aramids, ballistic nylon, glass fiber, carbon fiber, etc., or those materials formed by the overlaying of non-woven fibers such as Spectra. These multiple layers are united to form the resistant material which is a pliable multiple ply fabric where the plies are held together by adhesives, glues, fasteners such as staples or by sewing as well as by uniting of layers by hot pressing.

Aramid materials, polyethylene, woven nylon, and Ultra High Molecular Weight (UHMW) or similar types of materials are much more resistant to the above mentioned fastening techniques than other types of materials, and consequently have a tendency to come apart or come loose from the surface on which they are mounted, making them more susceptible to failure. Consequently, because of this tendency of such materials, providing an impact resistant and failure resistant frame highly resistant to such type of failure is important.

The use of a particular mounting frame for such armoring materials will therefore provide a very high effective armoring surface where failure will not occur due to impact close to the edges of the material. The mechanical mounting arrangement also makes it more readily possible to construct the edges of the material in the design configuration to also provide a very effective means of strongly fastening the armoring material over the surface to be protected.

Again referring to FIGS. 1 and 2, it will be noted that in addition to a dual row of staggered punched out openings 14 having a downwardly projecting material engaging piece 15, a second dual row of armoring fabric engaging elements 16, in the form of outwardly punched dimples into which the fabric flows, provide an additional manner of tightly holding the fabric in the frame 12.

It will be noted that the frame in cross-sectional is U-shaped, with an outward side edge central surface 17 uniting the upper frame surface 13 with the lower frame surface 18. The configuration of the dimples and pressed out spaces 16' and 14' respectively are the same as such elements in the upper surface 13, but that they are disposed in opposite corresponding relationship to each other in two staggered rows. Note that when the engaging element 15 is pressed downwardly into the armoring material, the opposed dimple 16' on the bottom surface will accept some pressed material, making a firmer bond between the material and the frame from which the fabric cannot be pulled on impact of a ballistic projectile.

The frame can be fabricated either as a rectangular frame, or in any desired angular planar configuration suitable for matching the surfaces to be covered.

Figure 4:
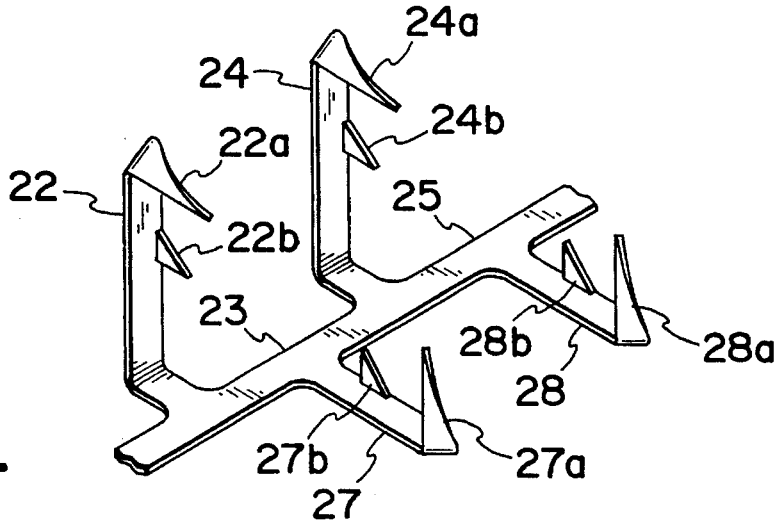
FIG. 4 is a partial perspective view of the frame element of FIG. 3.
Figure 3:
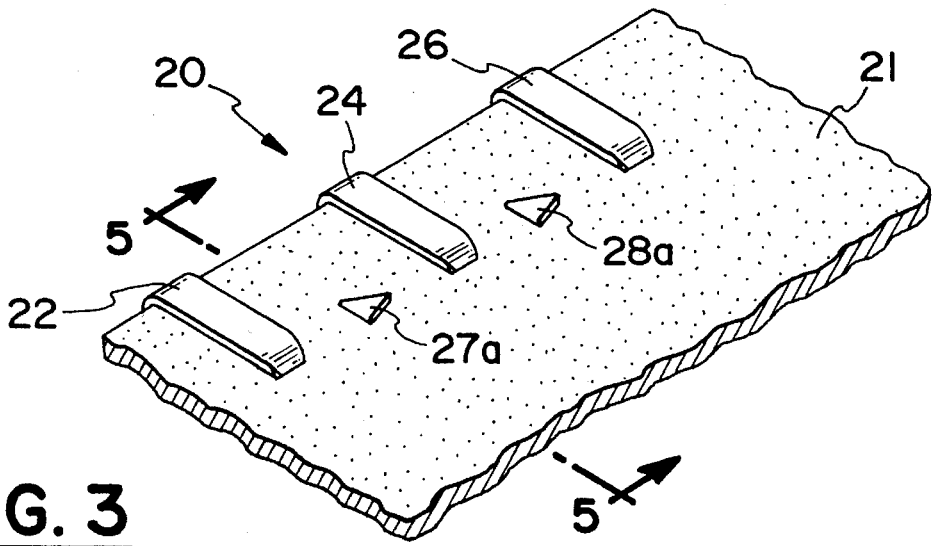
FIG. 3 is a perspective view of another type of peripheral frame assembly.
Figure 5:
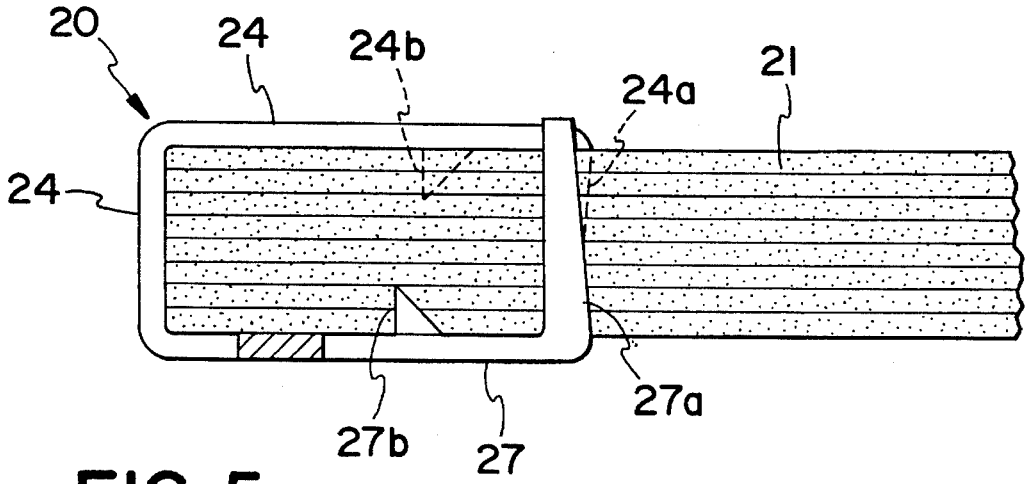
FIG. 5 is a sectional view along line 5—5 of FIG. 4.

FIGS. 3–5 illustrate a second type of edge securing frame, consisting of a number of bent over individual finger pieces. This configuration will more readily permit the contour matching of a given composite section of armoring material, since there is not a continuous metal piece for the entire periphery of the frame, such as the frame of FIGS. 1 and 2, which are primarily for use in applying the armoring material to a flat surface.

Referring particularly to FIGS. 3–5, the assembled frame and material along the edge of an armoring section is generally indicated at 20. The section of armoring material 21 is engaged by the plurality of fingers, such as finger 22 which has an end engaging prong **22*a* and an intermediate engaging prong 22*b*. The section 23 of the central spine 25 bridges finger 22 and finger 24. All of the fingers 22, 24, 26 which form the group of fingers for engaging the upper surface of the fabric are of identical construction. The finger 24 of the frame piece illustrated in FIG. 4, as well as finger 22 are shown in the initial pre-installed configuration prior to its engagement with the edge of the armoring material 21. The upper arm pieces 22, 24 and 26 are longer than the lower engaging arms 27, 28 so that, as indicated in the cross-sectional view of FIG. 5, when they are folded over the edge of the armoring material 21, their engaging prongs, such as prongs 24*a* and 24*b* of arm 24 engage and pass through the armoring material along a common line, which corresponds to the end line formed by the lower engaging arms 27 and 28, which is indicated in FIGS. 4 and 5. Note that the arms are bent from the point at which they are joined to the central spine sections 20, 23, 25, and that the elongated tips 22*a* and 24*a*** will pass completely through the thickness of the armoring material.

The edge section of the armoring material when it is initially placed on the frame, will be pierced by the upwardly projecting pointed engaging tabs **27*a* and 27*b* of engaging arm 27, and engaging tabs 28*a* and 28*b* of engaging arm 28. FIG. 4 indicates that the tips of the end engaging tabs 27*a* and 28*a* pass through the material and are bent over onto the material for a secure fastening arrangement (FIG. 4). The end engaging prongs 22*a* and 24*a*** similarly pass the armoring material and are bent over on the bottom surface of the material to provide for a secure fastening of the material which will preclude its being pulled out and away from the frame under loads absorbed by the material on impact of a ballistic projectile. Consequently, this finger type frame arrangement provides for both secure edge engagement of the armoring material as well as the capability of contour-bending of the framed section to match the contour of the surface to be protected.

It should be noted that both the frame of FIG. 1, as well as that of FIG. 3 provide for closely spaced armoring material engaging elements which each will coact with adjacent closely spaced pieces to absorb the load over a wider area by plural holding pieces engaging the material to prevent tearing of the material upon impact.

Figure 6:
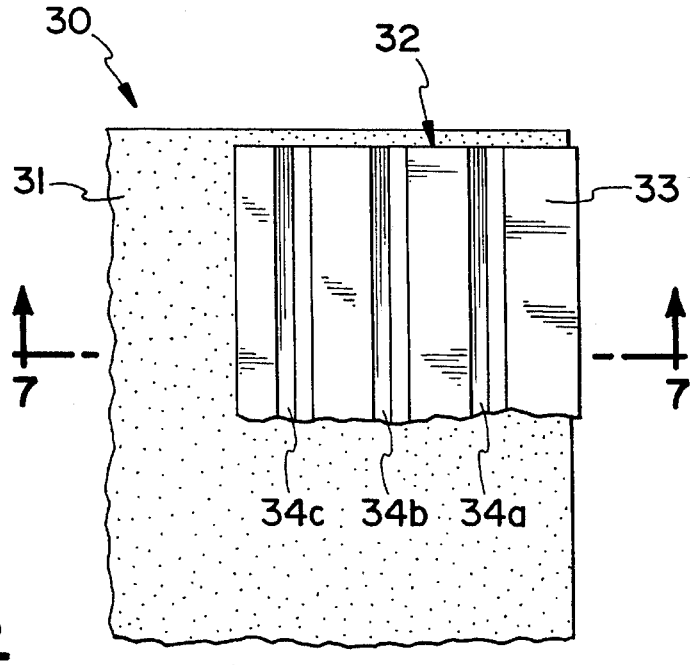
FIG. 6 is a partial plan view of another type of frame assembly.
Figure 7:
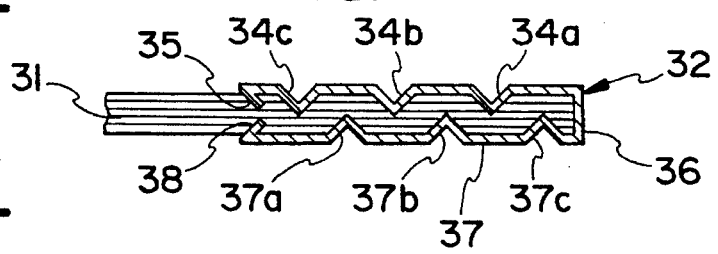
FIG. 7 is a cross-sectional view taken along line 7—7 of FIG. 6.

FIGS. 6 and 7 show a straight edge on the fabric gripping assembly generally indicated at 30 in which the edge section 31 of the fabric is gripped by a straight edge frame element generally indicated at 32 which has an upper surface 33 having three parallel longitudinally extending V groove engaging ribs **34*a*, 34*b*, and 34*c*. These ribs extend downwardly into the upper surface of the fabric 31, as shown in FIG. 7, to provide a continuous multiple gripping line extending the length of the straight edge. Additionally, upper surface 33 of the frame 32 has a continuous inwardly extending projection 35 extending along its entire edge which will also resist the movement of the edge section 31 of fabric out of the metal side frame member 32. A side edge section 36 of the frame 32 extends the length thereof and connects the upper surface 33 to the lower surface of the frame 37. The lower surface 37 of the frame has upwardly extending continuous V engaging grooves 37***a*, 37*b* and 37*c* which are offset and oppose the continuous grooves extending into the material from the upper surface 33. Lower surface 37 also has a continuous inwardly extending gripping element 38, similar to the gripping element 35. The staggered arrangement of the upper and lower ribs with respect to each other as shown in FIG. 7 provide a serpentine staggered gripping of the armoring in material which will not permit the edge section to forcibly be pulled from the frame 32.

Figure 8:
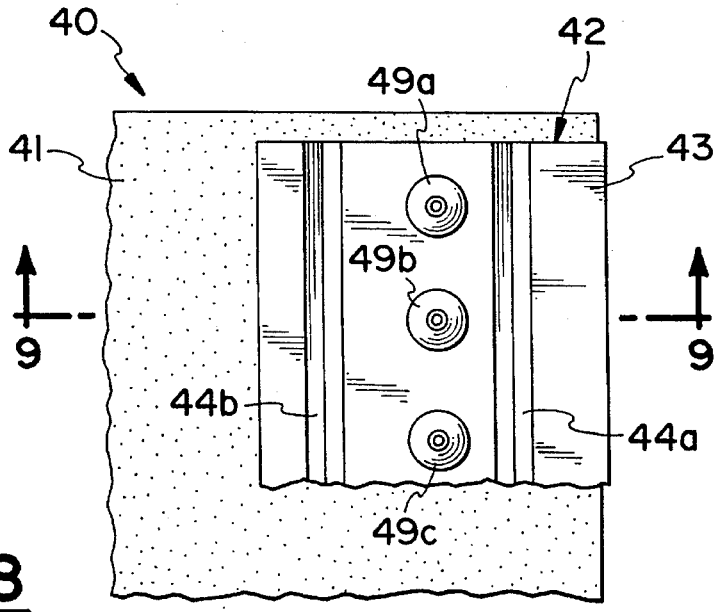
FIG. 8 is another partial plan view of another type of frame assembly.
Figure 9:
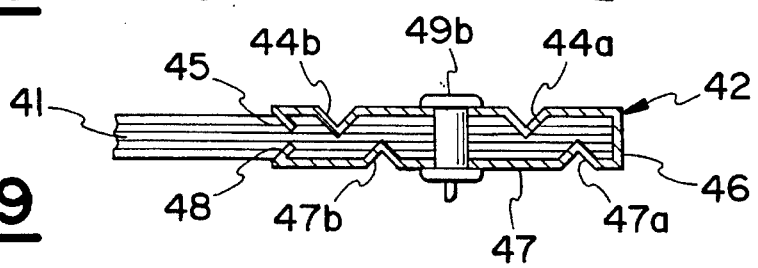
FIG. 9 is another cross-sectional view along line 9—9 of FIG. 8.

FIGS. 8 and 9 show a similar type of side frame arrangement similar to that of FIGS. 6 and 7, but with the substitution of additional rows of fastening pieces. Referring particularly to FIGS. 8 and 9, the side frame assembly generally indicated at 40 engages the edge section 41 of the armoring material with the straight side frame 42. The upper surface 43 has two longitudinally extending inwardly projecting ribs 44*a* and 44*b*, and along its inner edge a rearwardly inclined restraining element 45 which protrudes into the armoring material surface along the inner edge of the frame 42. The outer edge 46 of the frame joins the upper edge of the upper surface section 43 to the lower section 47. The longitudinally extending upwardly projecting V grooves 47*a* and 47*b* are similar to the grooves 44*a* and 44*b* and extend upwardly into the material along lines that are offset and out of alignment from the upper inwardly extending grooves. Rearwardly angled restraining element 48 is disposed along the inner edge of the lower frame surface 47. A series of rivet fasteners 49*a*, 49*b* and 49*c* extend through the frame upper and lower surfaces and as well as through the armoring material itself.

Figure 10:
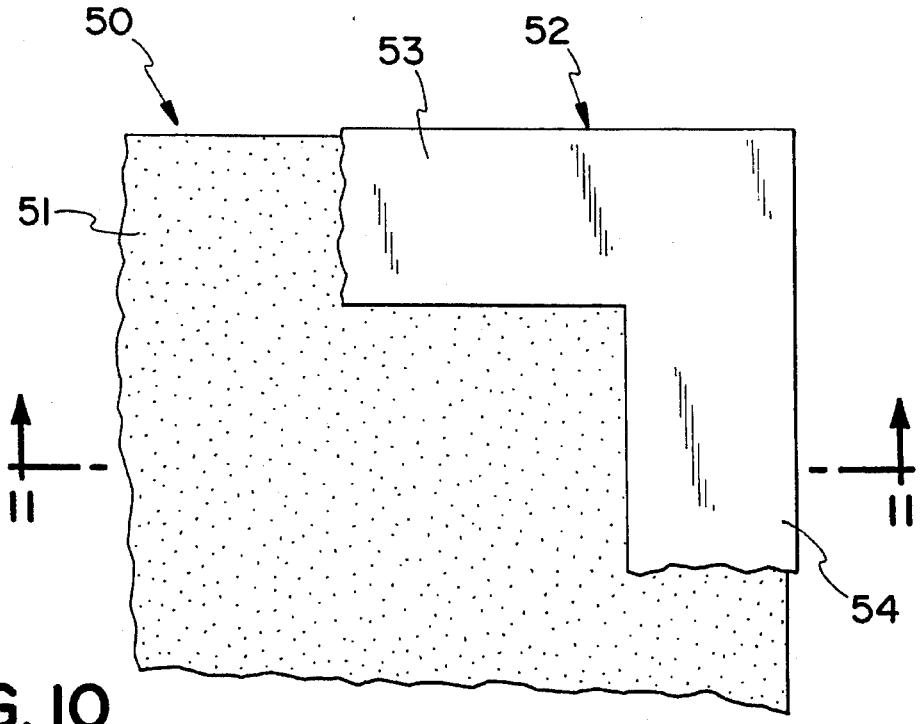
FIG. 10 is another partial plan view of a frame assembly illustrating the corner construction thereof.

The upper surface 54 of the side frame is connected by an outer surface section 56 to the lower facing surface section 57. The cross-sectional configuration as indicated at FIG. 10 is roughly that of a flat sided "U" shape the outer edge of the armoring material 51 is held within the frame by the two inwardly projecting inwardly inclined elements 55 and 58 which extend around the inner periphery of the frame, as indicated at 59.

Figure 11:
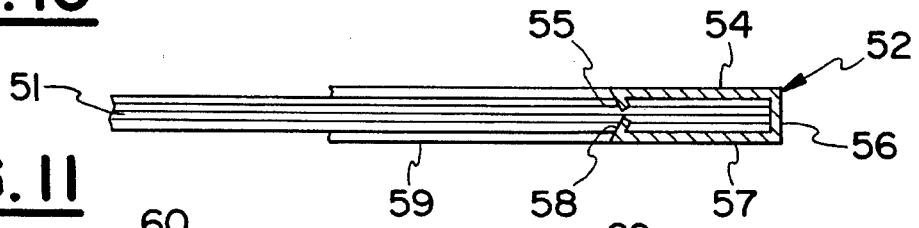
FIG. 11 is a cross-sectional view along line 11—11 of FIG. 10.
Figure 12:
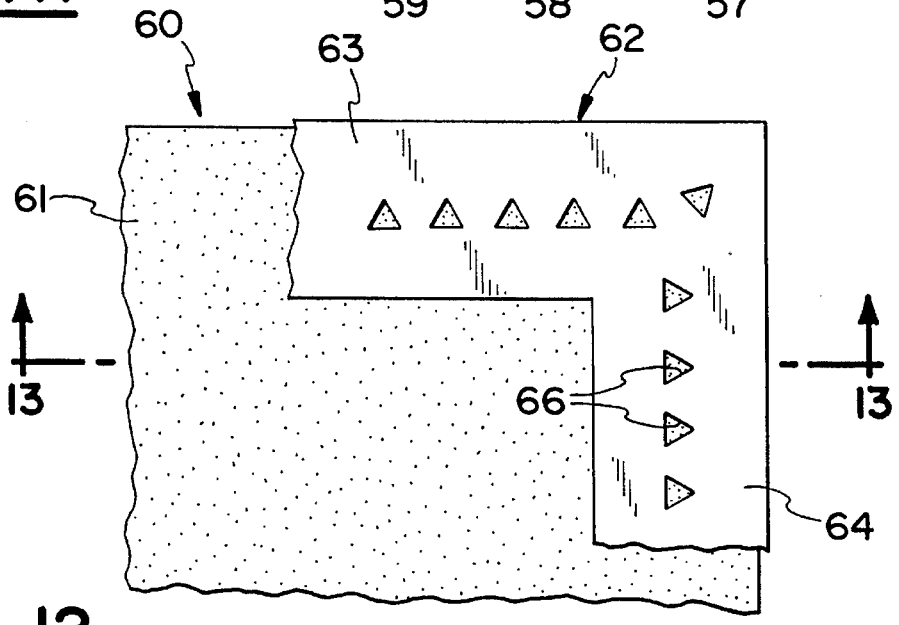
FIG. 12 is another partial plan view of a corner frame construction.
Figure 13:
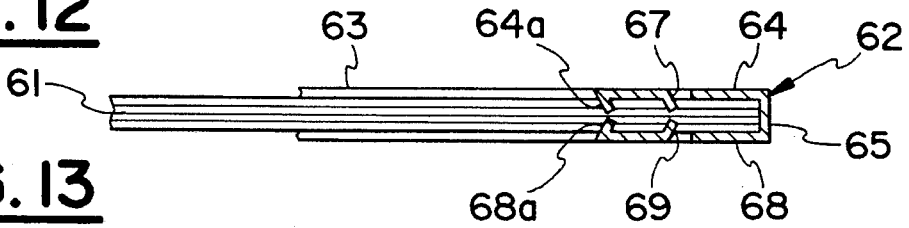
FIG. 13 is a cross-sectional view taken along line 13—13 of FIG. 12.

FIGS. 12 and 13 illustrate another manner of providing additional marking and gripping capability in a corner frame type piece. The overall assembly generally indicated at 60 includes an edge section 61 of armoring material which is engaged by the frame generally indicated at 62, which has an upper flat surface 63 extending inwardly from the far edge 65. The surface has the plurality of triangular punched out pieces 66 which provide an inwardly extending pointed element which penetrates the armoring material 61. The inner edge 64*a* of the upper frame surface 64 is an inwardly extending continuous locking piece which extends around the whole periphery in the same fashion as the locking pieces 55 and 58 of FIG. 11. The lower surface 68 of the frame 62 extends parallel to the upper surface 64 to form a U-shape for accommodating the outer edge periphery of the armoring material 61. There are also a series of triangular punched holes 67 in the lower surface 68 which produce the triangular pointed shaped elements 69. A rearwardly inclined locking element is a continuous piece 68*a* which extends along the entire inner periphery of the lower surface of the frame. Another side frame arrangement for anchoring the side support edge section generally indicated at 70 anchors the end section 71 of the armoring material by a U-shaped frame generally indicated at 72 having a top surface 73 an end outer surface 74 and a lower surface 75. In this modification there is a fold-over arrangement used to anchor the outer edge extremity 71*a* of the armoring material by an overfold of the upper frame surface 73 and the inner peripheral side 76, so that the anchoring outer side section 71*a* is folded over the central intermediate flange section 77 as indicated in FIG. 15 to provide a firm anchoring arrangement that will not fail when the armoring material is subjected to an impact from a ballistic projectile.

Figure 14:
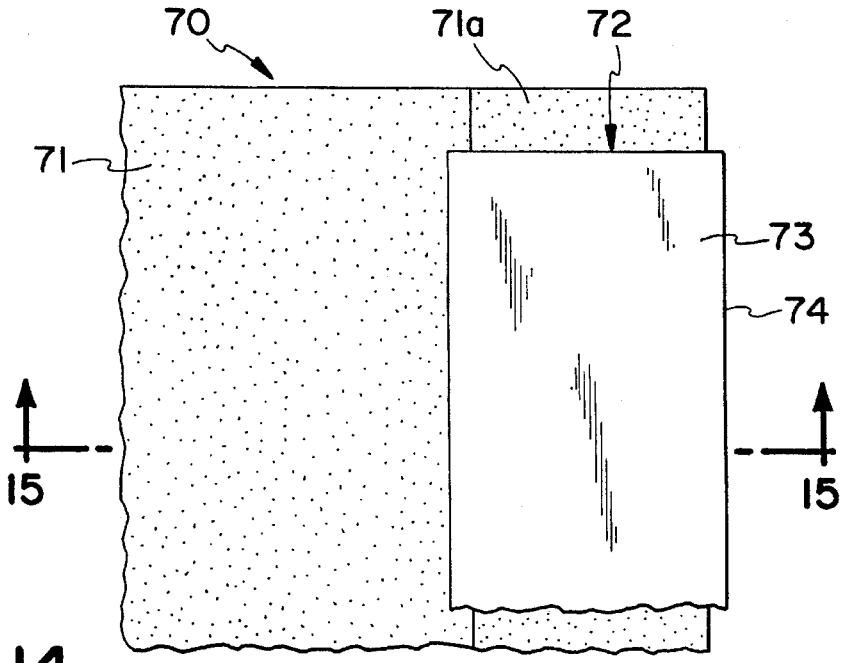
FIG. 14 is a partial plan view of another type of peripheral reinforcing for the edge of an armoring section.
Figure 15:
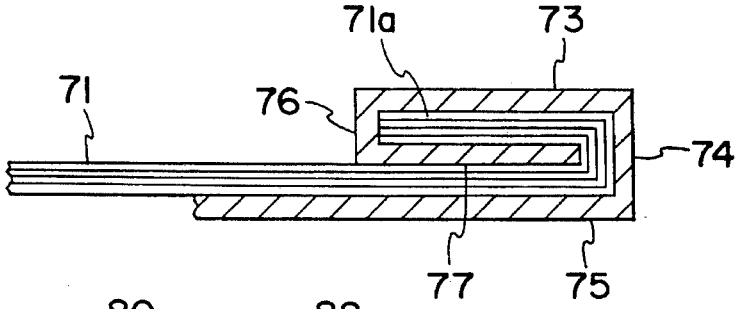
FIG. 15 is a sectional view taken along line 15—15 of FIG. 14.
Figure 16:
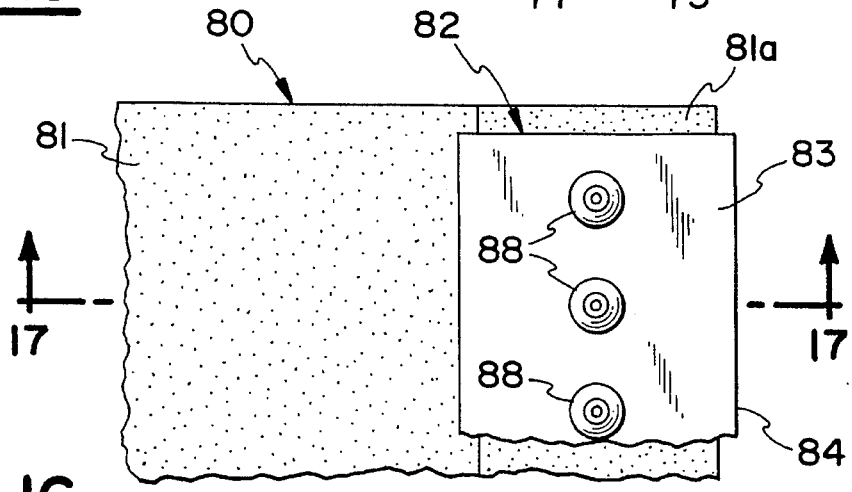
FIG. 16 is a partial plan view of an edge reinforcing frame construction utilizing a line of multiple fasteners.
Figure 17:
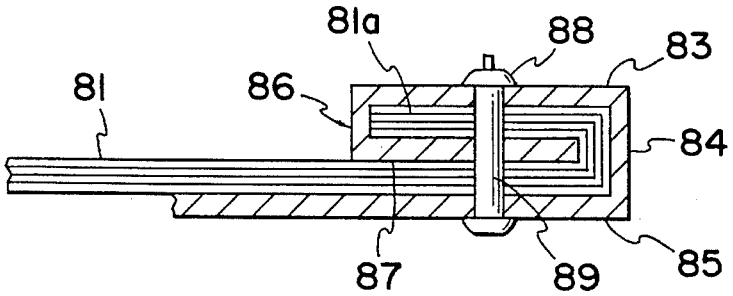
FIG. 17 is a sectional view along line 17—17 of FIG. 16.

FIGS. 16 and 17 illustrate another further modification of the type of side frame anchoring assembly illustrated in FIGS. 14 and 15. In this modification, generally indicated at 80, the end section 81 of the armoring material end section is folded within the side frame assembly 82 to anchor the end in the strip 81*a* of the armoring material adjacent its edge. The side frame 82 has an upper surface 83 extending inwardly from an outer peripheral vertical section side 84 which connects to the lower side element 85. The inner side surface 86 extends parallel to side 84 to provide a closed configuration which supports the end and intermediate anchoring flange section 87 around which the armoring material edge strip 81*a* is wrapped. A line of rivets 88 pass through the side anchoring assembly, including the upper and lower surface plates 83 and 85. The central shaft 89 of the rivets 88 provides an additional anchoring of the armoring material to prevent slippage.

Figure 18:
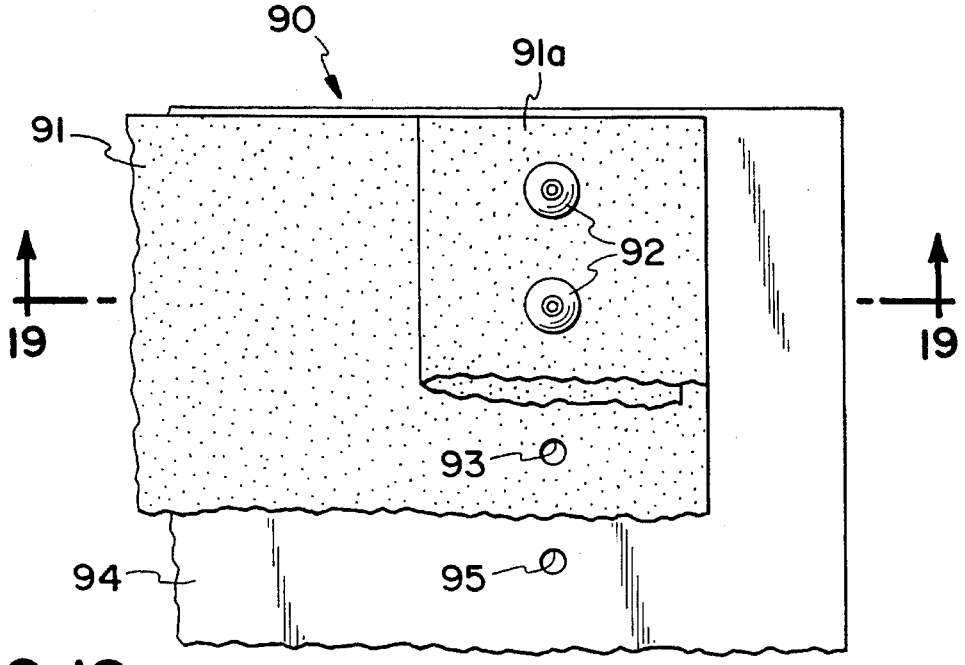
FIG. 18 is a partial plan view of an overfolded edge configuration.
Figure 19:
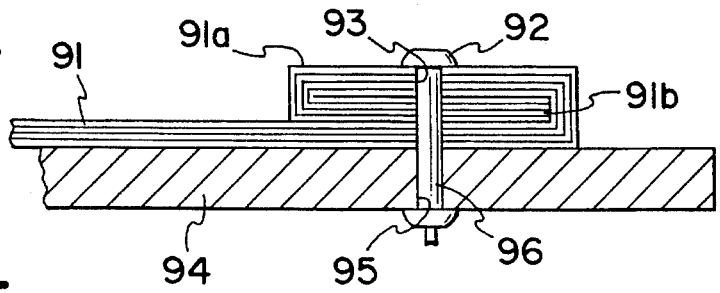
FIG. 19 is a sectional view along line 19—19 of FIG. 18.

FIGS. 18 and 19 show a top and a sectional view respectively of another arrangement for assuring that the armoring material will not be pulled away from the protected surface or pierced on impact of a ballistic projectile. An anchoring assembly generally indicated at 90 makes use of the multiple overfold of the edge material to provide an anchoring mechanism without requiring a metal side frame by overfolding two longitudinally extending edge sections 91*a* and 91*b* of the section of armoring fabric material 91. A closely spaced series of rivets 92 disposed in longitudinal alignment close to the edge of the armoring material section at a central pin section 93 which passes through both the overfolded fabric sections to secure it to the surface 94 on which it has been place. The shaft 93 passes downwardly through openings 95 and the plate 94. The rivet heads 96 hold the armoring fabric to the plate 94.

Figure 20:
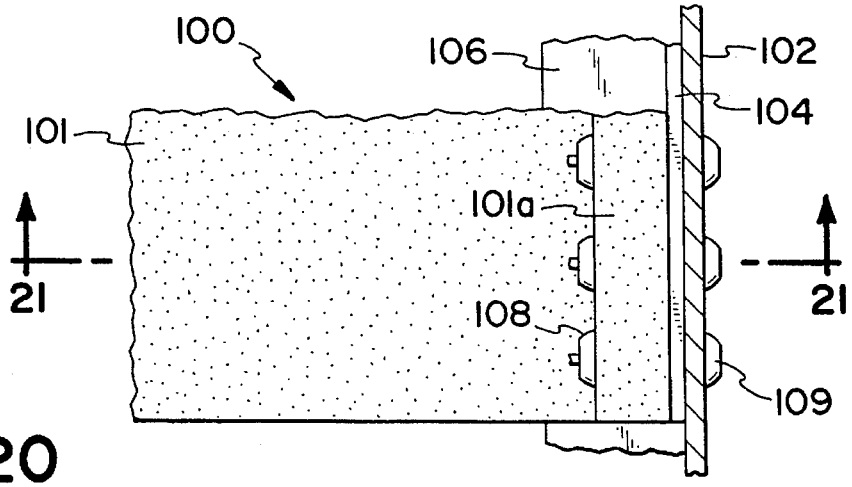
FIG. 20 is a partial plan view of another peripheral framing type of assembly for armoring material.
Figure 21:
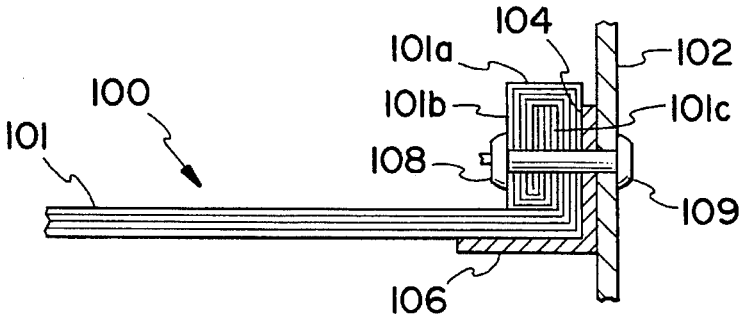
FIG. 21 is a cross-sectional view long line 21—21 of FIG. 20.

FIGS. 20 and 21 illustrate the use of the fastening arrangement of FIGS. 18 and 19 to a mounting which is not planar with the surface of the armoring fabric. Referring to FIGS. 20 and 21, a mounting assembly generally indicated at 100 for an armoring material edge section 101 shows a multiple overlap of linear extending edge sections 101*a*, 101*b* and 101*c* to provide a multiple layer edge which can be fastened to the vertical support plate 102. An intermediate angle iron having legs 104 and 106 provides a receptacle for the overfolded sections and permits a rigid fastening to the plate 102 by a closely spaced line of rivets 108 which pass through the plate from the rear side and engage the rear surface with the heads 109.

Figure 22:
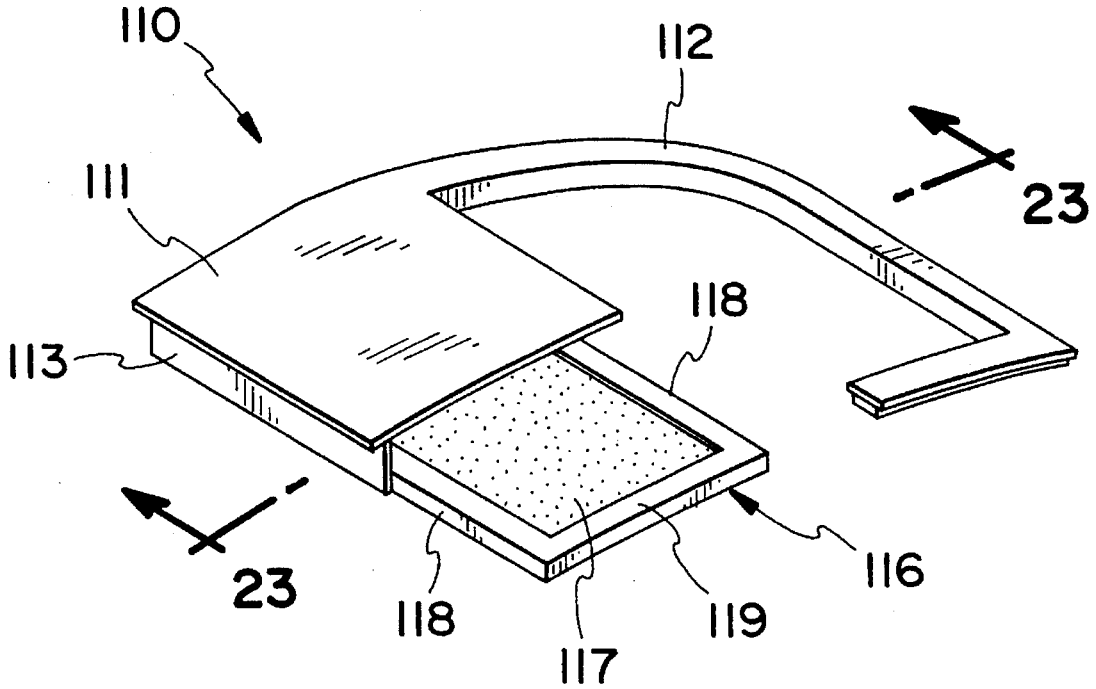
FIG. 22 is a perspective view of the door assembly of a vehicle illustrating the adding of an armoring section.
Figure 23:
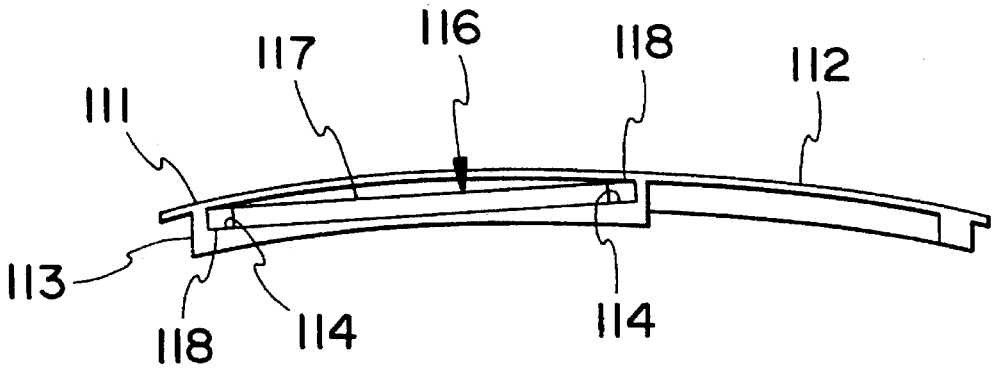
FIG. 23 is a sectional view of FIG. 22.

FIGS. 22 and 23 illustrate the manner of mounting a framed armoring fabric material to a vehicle door. The door assembly generally indicated at 110 has an upper arcuate window frame area 112 disposed above the exterior surface 111 which is to be protected by the armoring fabric material. The door panel 111 has a lower frame guide section 113 defining an inner slot frame receptacle cavity 114. The armoring fabric material mounting assembly generally indicated at 116 has an armoring material 117 mounting within the side frame members 118 and end frame member 119 slides into position behind the surface 111. The frame construction could be any one of the corner frame mounting arrangements previously described.

Figure 24A:
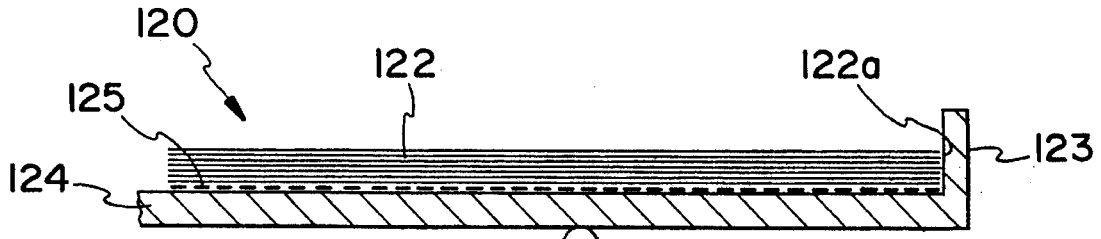
FIGS. 24*a*, 24*b*, 24*c*, 24*d* and 24*e* are a series of figures showing progressive travel of a projectile.

FIGS. 24*a*, 24*b*, 24*c*, 24*d* and 24*e* progressively show the manner in which an unframed and unanchored edge of an armoring material section will permit delamination and failure when it is struck by a ballistic projectile such as a bullet. FIG. 24*a* shows an armoring material protected assembly generally indicated at 120 with its side edge 122*a* mounting against and upwardly extending flange section 123. The armoring material 122 is fastened to the inner surface of the plate 124 by an adhesive 125. This figure shows the bullet 126 as it makes initial contact with the plate surface 124.

Figure 24B:
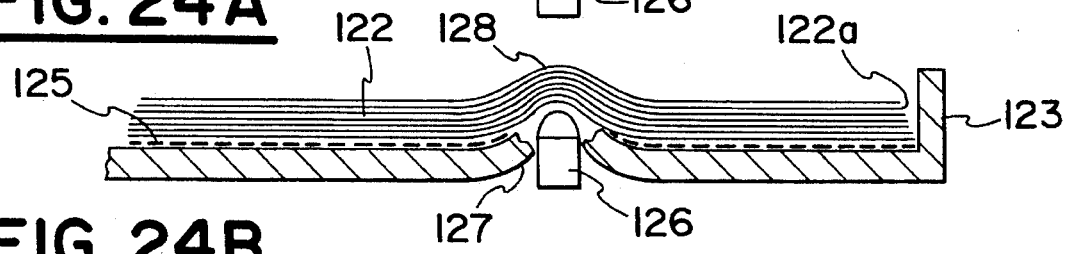
Figure 24C:
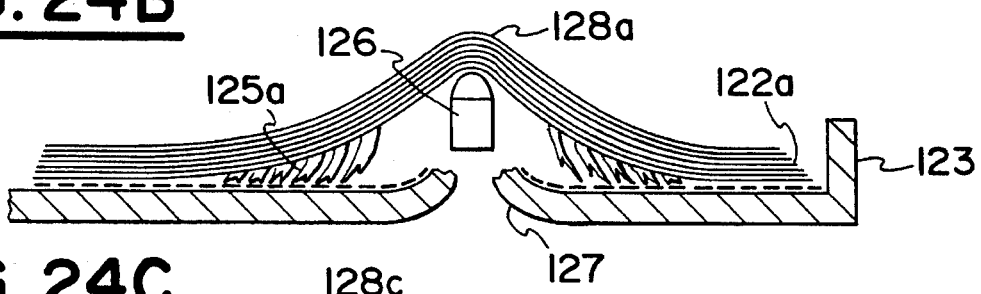

In FIG. 24*b* which is a sectional view identical to that of the other figures such as FIGS. 24*a* and 24*c*, the bullet is shown after it has pierced the plate 124 breaking through at 127 and making initial contact with the armoring layered fabric material, pressing it upward and away from its planar position in a hump 128 which surrounds the tip of the bullet.

The effect of the bullet on the armoring material mounting arrangement is illustrated in FIG. 24*c* which shows the bullet progressing further to raise the armoring material 122 upwardly in a high hill-like configuration, pulling the adhesive on the armoring material to the plate away from it, as illustrated by the stretched and failing glue pieces illustrated at 125*a*. Note also that the edge of the armoring material section 122*a* is being pulled away from the end flange 123.

Figure 24D:
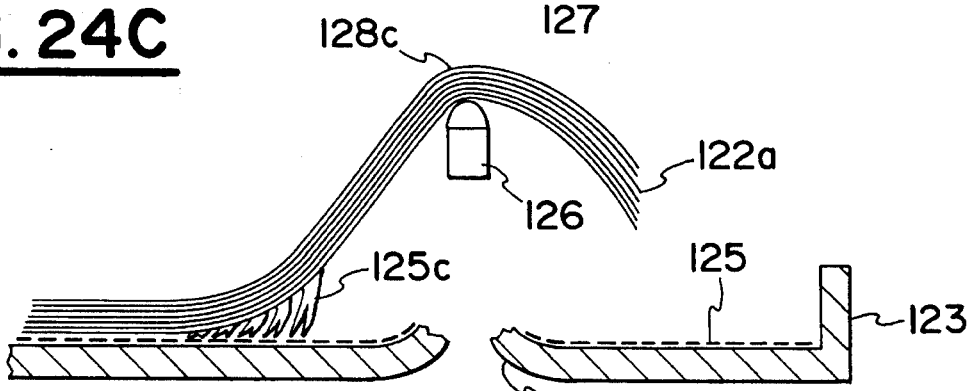

FIG. 24*d* is the next successive showing of the manner of failure of the typically and conventionally mounted armoring material. As shown, the bullet 126 has lifted the edge section of the armoring fabric material 122 free of the support plate 124 of the section adjacent the hole 127 and plate 124 and completely free of its edge section 123, producing a complete delamination in this critical area.

Figure 24E:
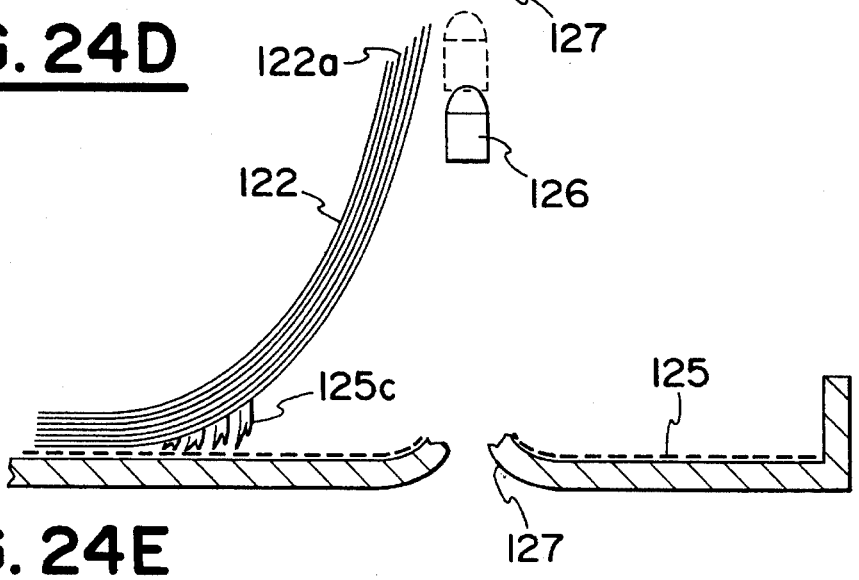

FIG. 24*e* shows the bullet 126 passing around the delaminated free edge 122*a* of the material. This is a complete failure of the armoring material, even though the bullet has been unable to pass through it. The overall effect is the same, however, since the bullet continues on its path unobstructed by the applied sheet of armoring material.

Figure 25A:
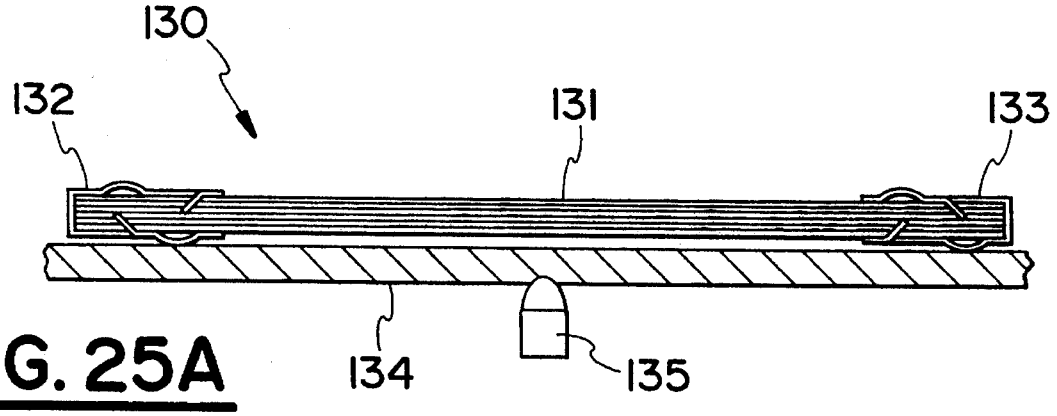
FIGS. 25*a*, 25*b* and 25*c* show successive impact of a bullet.
Figure 25B:
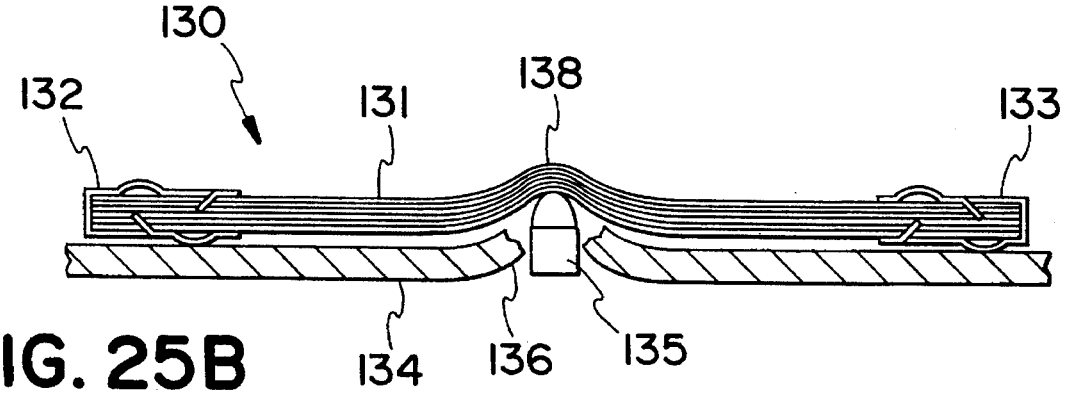
Figure 25C:
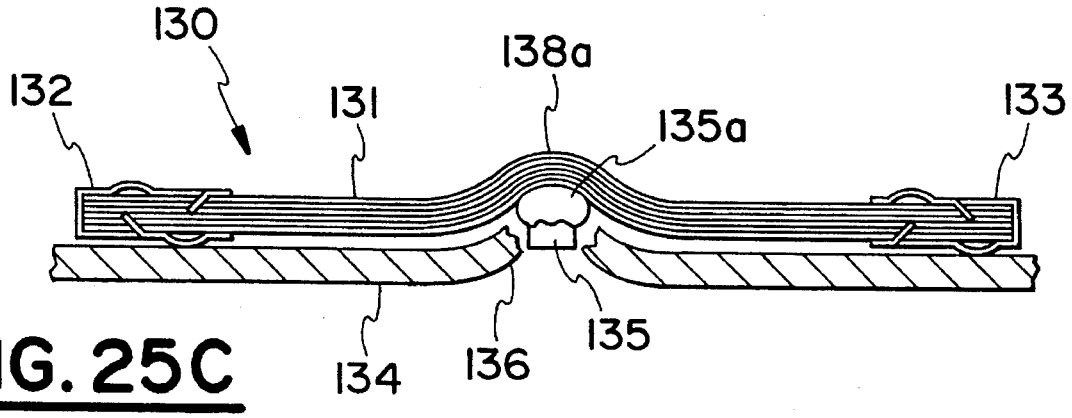

In contrast, FIGS. 25*a*, 25*b* and 25*c* illustrate the manner in which the same plate and bullet impact are restrained by armoring material held in position by the edge frame described in FIG. 1.

Referring to FIG. 25*a* the armoring assembly generally indicated at 130 includes the sheet of armoring material 131 mounted on the edges in frame of FIG. 1, shown in cross-section, in which the fabric material is stretched and retained between frame section 132 on one side and frame 133 on the other.

The frame is securely held to the plate member 134 which is to be protected by fastening and mounting means not shown. This shows the first phase in which the bullet 135 initially strikes the outer surface of the plate 134.

In FIG. 25*b*, the bullet has pierced the plate at 136 and has encountered the armoring material 131 which flexes away from the plane of the plate in a protrusion 138. The edges of the armoring fabric section 131 are held in place by the frame members 132 and 133.

The successful absorption of the bullet without failure of the assembly 130 is shown in FIG. 25*c*. The bullet 135 moves further against the fabric raising it only slightly further than as shown in FIG. 25*c* at 138*a* which is only slightly more of an upstanding hump. On full impact of the bullet against the armoring material the bullet itself collapses as shown in 135*a*, while the frame mounted on the fabric 131 does not tend to delaminate or come loose along its edges permitting the bullet to pass around the delaminated material.

Figure 26A:
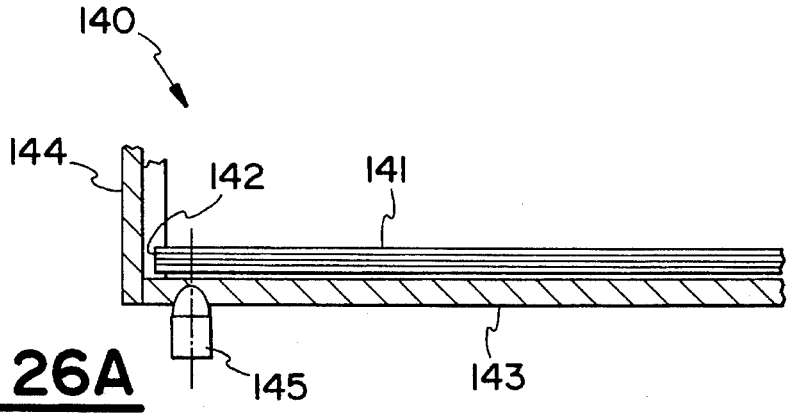
FIGS. 26*a*, 26*b*, 26*c*, and 26*d* show progressive damage during impact to a conventionally armored surface.
Figure 26B:
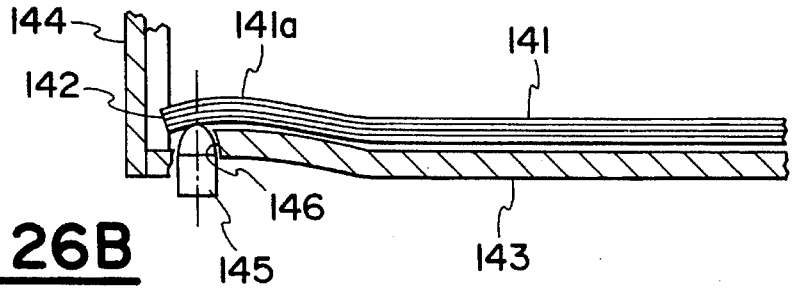
Figure 26C:
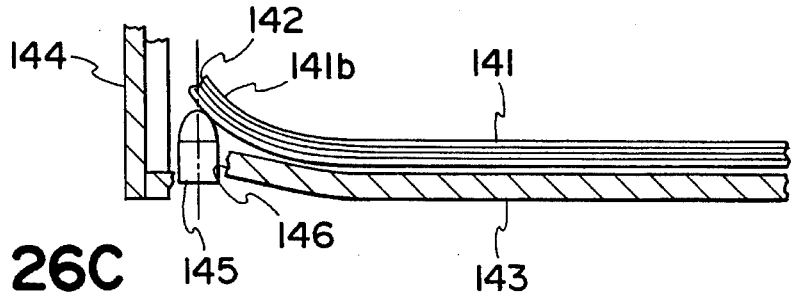
Figure 26D:
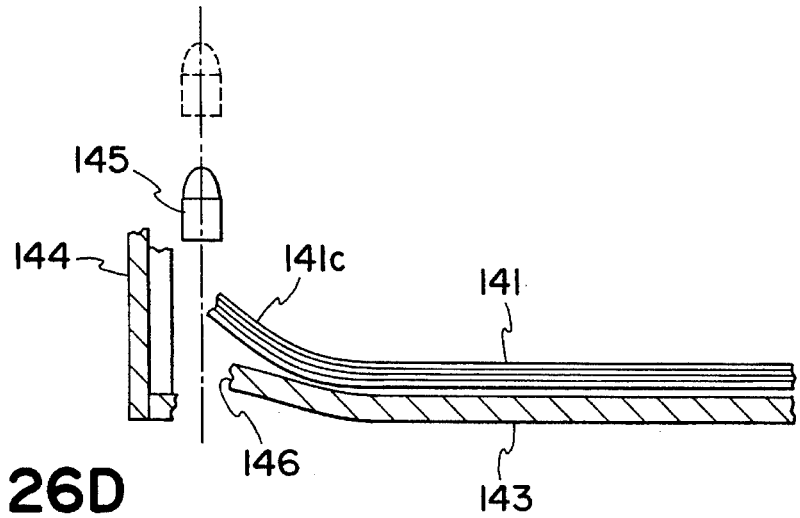

Another example of failure of the armoring assembly without anchoring is illustrated in FIGS. 26*a*, 26*b*, 26*c*, and 26*d*. The assembly generally indicated at 140 is a conventionally attached reinforcing arrangement in which the reinforced fabric material 141 is glued to the plate 143 and abuts the side plate 144 at its edge 142. There is no additional securing means at this point, which is the point of weakness. A bullet striking this particular area, such as bullet 145 will readily penetrates the metal plate 143 as shown at 146 in FIG. 26*b*. FIG. 26*c* discloses the projectile 145 passing through the break 146 in plate 143 and bending up end section 141*b* displacing end 142. FIG. 26*d* illustrates the bullet 145 passing through unobstructed at the unsecured edge portion.

In contrast, FIGS. 27*a*, 27*b*, 27*c* and 27*d* illustrate how the frame construction of FIGS. 1 and 2 will counteract the failure that occurs when the projectile hits the edge of the material such as just described in FIGS. 26*a–d*.

Figure 27A:
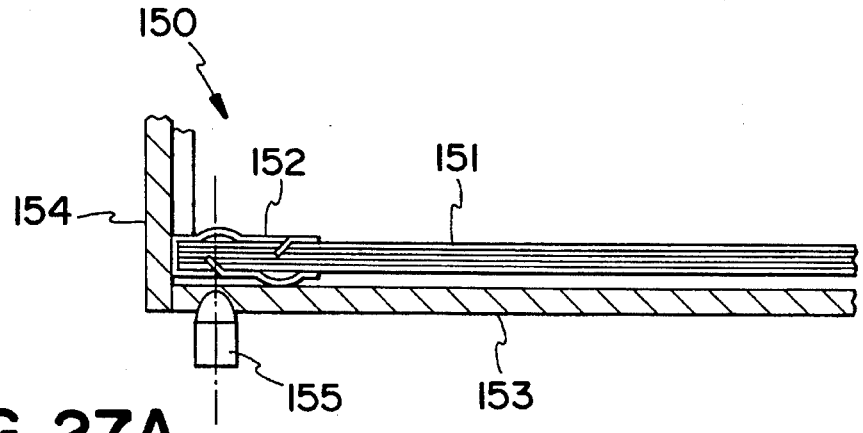
FIGS. 27*a*, 27*b*, 27*c*, and 27*d* are cross-sectional views of an armoring assembly as shown in FIGS. 1 and 2, illustrating the successive progression of a ballistic projectile striking the assembly.
Figure 27B:
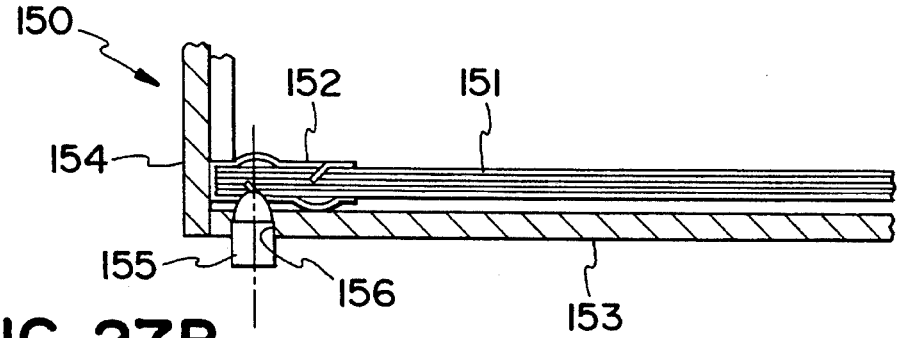

The edge reinforced assembly generally indicated at 150 shows the laminated armoring material 151 secured at its edge by the frame 152 which is secured to the plate and protected assembly 153 and 154. The projectile in 27*a* is shown at the point of impact as it begins to pass through the plate 153. In FIG. 27*b* the projectile has passed through the plate 153 at 156 and engages the reinforced edge material passing through its outer shell and encountering the armoring material fabric.

Figure 27C:
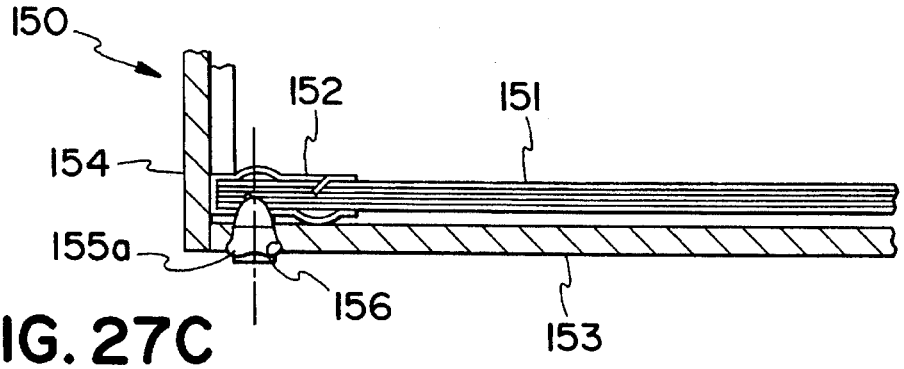
Figure 27D:
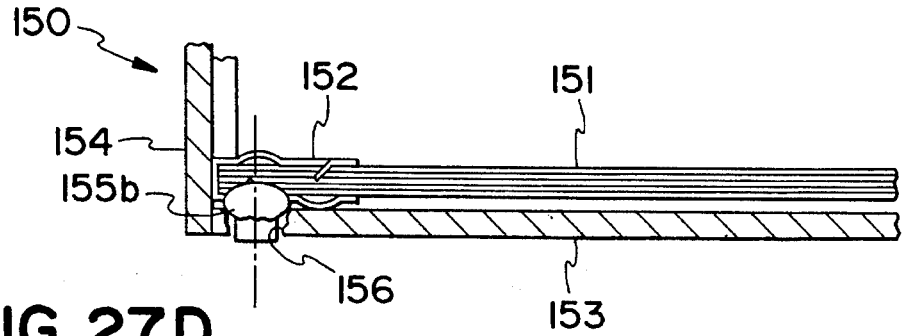

In FIG. 27*c* the projectile is shown with its full progress completely arrested by the reinforced edge construction 152. The bullet 155 itself begins to collapse at 155*a*. In FIG. 27*d* the completely collapsed bullet is illustrated at 155*b*. The armoring assembly is kept in tact.

These and other further advantages have been described as having a preferred design, although it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, as may fall within the scope of the invention or limits of the claims appended hereto.

I claim:

1. A reinforced mounting assembly for armoring material that is resistant to projectile damage or fracture or failure comprising:

a) a multi-layered armoring material for covering a given area of a structure to be protected and preventing projectiles from passing therethrough;

b) an edge reinforcing element comprising opposed first and second plates configured to receive therebetween an edge of said armoring material;

c) one of said first and second plates including at least one convex dimple structure projecting outwardly therefrom; and d) the other of said first and second plates including at least one engaging member cooperating with and having a common axis with said at least one dimple structure, said at least one engaging member projecting into said armoring material and deforming said armoring material against said at least one convex dimple structure to thereby retain said armoring material in position within said edge reinforcing element at all times.

2. The reinforced mounting assembly as set forth in claim 1 and wherein:

a) said edge reinforcing element has a C-shaped cross section.

3. The reinforced mounting assembly as set forth in claim 1 and wherein:

a) each of said at least one convex dimple structure and said at least one engaging member are disposed in at least two parallel longitudinally extending rows alternately spaced with respect to each other.

4. The reinforced mounting assembly as set forth in claim 1 and wherein:

a) each of said at least one convex dimple structure and said at least one engaging member are arranged in a staggered fashion on said first and second plates.

5. The reinforced mounting assembly as set forth in claim 1 and wherein:

a) said at least one convex dimple structure has a substantially circular perimeter.

6. The reinforced mounting assembly as set forth in claim 1 and wherein:

a) said at least one engaging member includes a tab member extending from said other of said first and second plates toward said one of said first and second plates.

7. The reinforced mounting assembly as set forth in claim 6 and wherein:

a) said tab member is crescent shaped.

8. The reinforced mounting assembly as set forth in claim 6 and wherein:

a) said edge reinforcing element having an interior and exterior perimeter; and b) said tab member extends in a direction towards said exterior perimeter of said reinforcing element.

9. The reinforced mounting assembly as set forth in claim 1 and wherein:

a) said at least one engaging member projects a substantial depth below the surface of said armoring material.

10. A frame assembly for securely mounting an armoring material that is resistant to projectile damage or fracture or failure comprising:

a) an edge reinforcing element comprising opposed first and second plates configured to receive therebetween an edge of a multi-layered armoring material to be mounted;

b) one of said first and second plates including at least one convex dimple structure projecting outwardly therefrom; and c) the other of said first and second plates including at least one engaging member cooperating with and having a common axis with said at least one dimple structure, said at least one engaging member adapted to project into said armoring material and cause deformation of the armoring material against said at least one convex dimple structure thereby retaining the armoring material in position within said edge reinforcing element at all times.

11. The frame assembly as set forth in claim 10 and wherein:

a) said edge reinforcing element has a C-shaped cross section.

12. The frame assembly as set forth in claim 10 and wherein:

a) each of said at least one convex dimple structure and said at least one engaging member are disposed in at least two parallel longitudinally extending rows alternately spaced with respect to each other.

13. The frame assembly as set forth in claim 10 and wherein:

a) each of said at least one convex dimple structure and said at least one engaging member are arranged in a staggered fashion on said first and second plates.

14. The frame assembly as set forth in claim 10 and wherein:

a) said at least one convex dimple structure has a substantially circular perimeter.

15. The frame assembly as set forth in claim 10 and wherein:

a) said at least one engaging member includes a tab member extending from said other of said first and second plates toward said one of said first and second plates.

16. The frame assembly as set forth in claim 15 and wherein:

a) said tab member is crescent shaped.

17. The frame assembly as set forth in claim 15 and wherein:

a) said edge reinforcing element having an interior and exterior perimeter; and b) said tab member extends in a direction towards said exterior perimeter of said reinforcing element.

18. The frame assembly as set forth in claim 10 and wherein:

a) said at least one engaging member adapted to project a substantial depth below the surface of the armoring material.

* * * * *